US011959275B2

(12) United States Patent
Yu et al.

(10) Patent No.: US 11,959,275 B2
(45) Date of Patent: Apr. 16, 2024

(54) MODULAR PARTITION SYSTEM

(71) Applicants: Sloane Sirong Yu, Emerald Hills, CA (US); Pamela Maria Calderon, San Jose (CR)

(72) Inventors: Sloane Sirong Yu, Emerald Hills, CA (US); Pamela Maria Calderon, San Jose (CR)

( * ) Notice: Subject to any disclaimer, the term of this patent is extended or adjusted under 35 U.S.C. 154(b) by 0 days.

(21) Appl. No.: 16/932,796

(22) Filed: Jul. 19, 2020

(65) Prior Publication Data

US 2022/0018123 A1 Jan. 20, 2022

(51) Int. Cl.
*E04B 2/74* (2006.01)
*E04B 1/343* (2006.01)

(52) U.S. Cl.
CPC ..... *E04B 2/7459* (2013.01); *E04B 1/34321* (2013.01); *E04B 1/34384* (2013.01); *E04B 2002/7461* (2013.01)

(58) Field of Classification Search
CPC ..... E04B 2/7459; E04B 1/34384; E04B 1/34321; E04B 2002/7461
See application file for complete search history.

(56) References Cited

U.S. PATENT DOCUMENTS 3,083,795 A * 4/1963 Land ..... E04B 2/821 52/126.7
4,726,567 A * 2/1988 Greenberg ..... E04B 2/16 256/19
5,218,797 A * 6/1993 Kruse ..... E01F 8/0017 52/169.9
5,966,885 A * 10/1999 Chatelain ..... E04C 2/22 52/309.4
6,349,512 B1 * 2/2002 Berkey ..... E04G 25/06 52/126.6
8,839,593 B2 * 9/2014 Barrett ..... E04C 3/34 52/834
10,221,529 B1 * 3/2019 Sanders ..... E01F 15/086
10,344,489 B2 * 7/2019 Koss ..... E04G 25/02
10,400,402 B1 * 9/2019 Sanders ..... H02G 1/08
11,085,182 B2 * 8/2021 Rosan ..... E04B 2/7448
11,408,173 B2 * 8/2022 Fermanian ..... E04B 2/26
2010/0180527 A1 * 7/2010 Kim ..... E04C 1/40 52/309.13
2011/0283657 A1 * 11/2011 Barrett ..... E04C 3/34 264/219
2018/0328055 A1 * 11/2018 Koss ..... E04H 9/02
2020/0217067 A1 * 7/2020 Rosan ..... E04B 2/7448
2021/0156147 A1 * 5/2021 Fermanian ..... E04B 2/26

* cited by examiner

*Primary Examiner* — Rodney Mintz
(74) *Attorney, Agent, or Firm* — Ronald C Gorsche, PLLC

(57) ABSTRACT

The invention generally pertains to a modular partition system. By way of one example, the modular partition system is constructed of a number of modular partition segments having an adjustable pole support member, a plurality of lightweight, compressible foam blocks configured to be attached to and removed from the adjustable pole support member and a plurality of foam block covers sized to be securely affixed to the front and back of a compressible foam block to provide strength and structural support to each compressible foam block of the modular partition. Using a combination of multiple sized modular partition segments, a larger size room may be partitioned to create a relative soundproof barrier between the newly created adjacent rooms.

18 Claims, 12 Drawing Sheets

MODULAR PARTITION SYSTEM

BACKGROUND

This invention relates to a modular partition system, and more particularly to a lightweight modular partition system that is easy to assemble and adaptable to multiple room shapes, ceiling heights and floor plan configurations.

Residential space sharing is common and has become even more common place when considering the skyrocketing rental rates in many US cities. Our first roommates may have been a sibling, and then a college buddy. In crowded cities, young professionals are converting living rooms to bedrooms. It is also common for residents of nursing homes and assisted living centers to have roommates. While there are benefits to having companionship and accessibility, there is unquestionable value in privacy and silence.

Modular components for dividing a larger space into one or more smaller spaces, cubicles, and partitioned rooms are well known. At least one advantage of modular wall systems is that they are relatively easy to configure. In addition, modular wall systems can be less expensive to set up and can allow for reconfiguration more easily than more permanently constructed dividers. For example, one may construct a room partition or a set of offices within a larger space in a relatively short period of time with the use of modular wall systems. If space needs change, one may readily reconfigure the space.

In general, modular partitions typically include a series of individual wall modules (and/or panels). The individual wall modules are typically free-standing or rigidly attached to one or more support structures. A manufacturer or assembler can usually align and join the various wall modules together to form an office, a room, a hallway, or otherwise divide an open space.

Features and advantages of the present invention will become apparent to those skilled in the art upon consideration of the following detailed description of embodiments.

BRIEF SUMMARY

In one embodiment, a modular partition system having multiple modular partition segments is disclosed. As illustrated and described herein, a modular partition segment is typically is constructed using an adjustable pole support member configured to be rigidly secured between the floor and the ceiling. A plurality of compressible foam blocks is provided in combination to form the partition or wall, which are configured to be attached and removed from the adjustable pole support member. In an embodiment, each compressible foam block has a u-shaped connector channel at one end that matched the size and shape of the adjustable pole support member for securing each block to the pole support. In addition to securing the block to the pole, the connector channel is designed to have a little bit of a space or give that allows the compressible foam block to rotate relative to the adjustable pole support member such that the entire final partition segment constructed of a plurality of compressible foam blocks rotates around the adjustable pole support member. A plurality of foam block covers that are sized to be securely attached to the front and back of a compressible foam block are also provided that give strength, stability and structural support to each compressible foam block of the modular partition, which in turn strengthens the entire modular partition segment.

In another embodiment, an upper block housing having an upper block housing channel and a lower block housing having a lower block housing channel are provided to receive a foam block cover, also illustrated and referred to herein as a rigid foam block face plate. The upper block housing and lower block housing are designed to be removably attached to the top and bottom of each compressible foam block. In one embodiment, each foam block cover snap fits within the upper block housing channel and the lower block housing channel to secure the cover in place. The snap cover may be removably attached or permanently fixed to the upper block housing channel and lower block housing channel, depending upon the desired design and use.

In another embodiment, a plurality of front foam block covers and a plurality of rear foam block covers is provided. The front foam block cover is configured to be affixed to the front of a compressible foam block. The rear foam block cover is configured to be affixed to the rear of a compressible foam block. Any method of securing a foam block cover to a compressible foam block may be used, either temporarily or permanently depending upon the design and construction needs, without departing from the scope and spirit of the present invention.

In yet another embodiment, a compressible top foam block face plate is provided that is designed to be attached to the upper block cover housing and lower block cover housing on the front and back of the compressible foam block closest the ceiling. The compressible top foam block face plate is designed to conform to the contour of the ceiling to create a tight seal between the ceiling and the modular partition to add improved sound proofing, sanitary separation, and privacy.

In still another embodiment, adjustable pole support member is seated within an outer sheath. Outer sheath is configured to rotate relative to adjustable pole support member, which may be fixed to the floor and ceiling. A plurality of compressible foam blocks is fixed to the outer sheath such that a partition comprised of a plurality of compressible foam blocks fixed to the outer sheath rotates relative to the adjustable pole support member.

In still another embodiment, a tension pole support member is provided as an adjustable pole support member that has a base plate, a plurality of rubber pads fixed to the base plate and the top surface of the tension pole support member, and a jackscrew expansion mechanism. In operation, the jackscrew expands the length of the pole to create tension between the floor and ceiling to hold the tension pole support member securely in place.

In still another embodiment, a free-standing adjustable pole support member comprises a pole support member base and adjustable pole member, which may be telescoping or fixed and may also include a rotating outer sheath so the partition will rotate relative to the free-standing adjustable pole support member. Free standing adjustable pole support member is designed for use with a room having high ceilings.

In another embodiment, a modular partition segment is provided for use as part of a modular partition system in a room having a floor and a ceiling. The modular partition segment has an adjustable pole support member are designed and constructed to be rigidly secured between the floor and the ceiling. A plurality of compressible foam blocks designed to be both attached and removed from the adjustable pole support member to form the partition of the partition segment. Each block has a connector channel at one end, sized to match the circumference of the adjustable pole support member, for removably coupling each compressible foam block to the pole support. The connector channel also allows the compressible foam block to rotate relative to the adjustable pole support member. An upper block housing and a lower block housing are removably attached to the top and bottom of each compressible foam block together configured to receive a rigid foam block face plate, typically within channels formed on each block housing. A plurality of rigid foam block face plates is provided that are configured to attach to the upper block cover housing and lower block cover housing on the front and back of each compressible foam block. Each rigid foam block face plate typically snap fits within the space created between the upper block housing and the lower block housing providing strength and structural support to each foam block of the modular partition.

A modular partition system having a plurality of modular partition segments for use in a room having a floor and a ceiling is provided. In general, the modular partition system is provided to a user with multiple parts to construct several partition segments for any size room. The system provides a plurality of adjustable pole support members that is configured to be rigidly secured between the floor and the ceiling. A plurality of compressible foam blocks is also proved with the system that are configured to be attached and removed from the adjustable pole support member. Each block has a connector channel at one end for securely fastening each compressible foam block to the adjustable pole support. The fit between the connector channel and the adjustable pole support member is not tight but instead permits the compressible foam block to rotate relative to the adjustable pole support member. A plurality of foam block covers is provided with the system sufficiently sized to be securely affixed to the front and back of a compressible foam block. The plurality of foam block covers provides strength and structural support to each foam block of the modular partition.

In another embodiment of the modular partition system, a plurality of upper block housing members each having an upper block housing channel and a plurality of lower block housing member having a lower block housing channel is provided. The upper block housing member and lower block housing member are removably attached to the top and bottom of each compressible foam block. Each foam block cover snap fits onto the upper block housing channel and the lower block housing channel and occupies the space created between the upper block housing member and the lower block housing member.

In another embodiment of the modular partition system, the plurality of foam block covers further comprise a plurality of front foam block covers and a plurality of rear foam block covers. Each front foam block cover is configured to be affixed to the upper block housing channel and the lower block housing channel on the front of a compressible foam block. Each rear foam block cover is configured to be affixed to onto the upper block housing channel and the lower block housing channel on the rear of a compressible foam block.

One of ordinary skill in the art will appreciate the overall modular partition system is scalable and may have any number modular partition segments associated therewith such that it is possible to use multiple sized compressible foam blocks to create any number of configurations. The scalability of multiple partition design configurations and the lightweight nature of the resulting structure makes it very easy to quickly exit through the partition in case of fire or other emergency needs.

The foregoing and other features, utilities and advantages of the invention will be apparent from the following more particular description of various embodiments of the invention as illustrated in the accompanying drawings and claims.

BRIEF DESCRIPTION OF THE DRAWINGS

The accompanying drawings, which are incorporated into and form a part of the specification, illustrate one or more embodiments of the present invention and, together with the description, explain the principles of the invention. The drawings are only for the purpose of illustrating one or more preferred embodiments of the invention and are not to be construed as limiting the invention. In the drawings.

Reference will now be made in detail to embodiments of the invention, examples of which are illustrated in the accompanying drawings. Throughout the following detailed description, the same reference characters refer to the same or similar elements in all figures.

DETAILED DESCRIPTION

In the following description, numerous specific details are set forth, such as examples of specific shapes, components etc., to provide a thorough understanding of the present invention. It will be apparent, however, to one skilled in the art that the present invention may be practiced without these specific details. In other instances, well known components or methods have not been described in detail, but rather in general terms in order to avoid unnecessarily obscuring the present invention. Thus, the specific details set forth are merely exemplary. The specific details may be varied from and still be contemplated to be within the spirit and scope of the present invention.

Reference to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
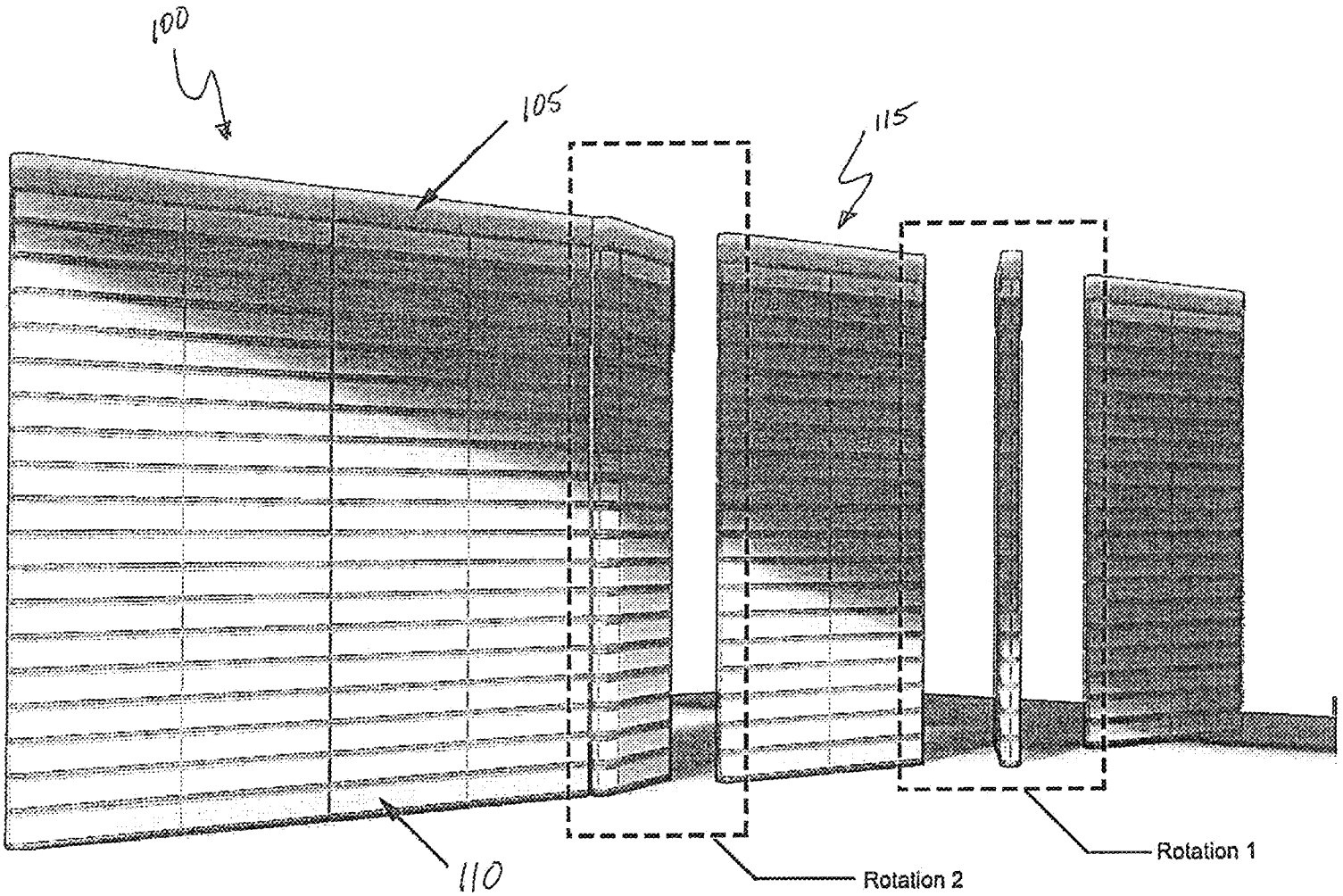
FIG. 1 is front view of a modular partition system having multiple modular partition segments in accordance with the present invention.

FIG. 1 is front perspective view of modular partition system 100 in accordance with one aspect of the present invention. In the illustrated embodiment, modular partition system 100 is comprised of several modular partition segments 115 having a plurality of compressible foam blocks with a compressible top foam block face plates 105 and a plurality of compressible foam blocks having rigid foam block face plates 110. One of ordinary skill in the art can appreciate that various sized lengths and widths of partitioning partitions of the modular partition system may be constructed utilizing the inventive aspects of the disclosed design of the modular partition segments without departing from the scope and spirit of the present invention. The compressible foam blocks are constructed of a compressible foam material that is strong yet lightweight meaning each modular partition segment 115 of the modular partition system 100 may be easily constructed by a single individual with little to no knowledge of the use of complex tools and difficult assembly practices. Moreover, the construction materials associated with the modular partition system 100 described herein are extremely lightweight and compact so standard shipping is sufficient, i.e., special movers and storage are unnecessary to construct the partition segments 115 of the modular partition system 100.

As shown in FIG. 1, each modular partition segment 115 that makes up the modular partition system 100 is easily moved, shifted rotated or even knocked down if necessary to allow for emergency exit from one room to another if a quick egress for fire or safety reasons is needed. Importantly, the modular partition system 100 is not a permanent wall structure but more a temporary partition structure that provides a relative soundproof and sanitary barrier between adjacent spaces while still allowing a person to get from one side of the partition to the other quickly and safely if needed.

Figure 2:
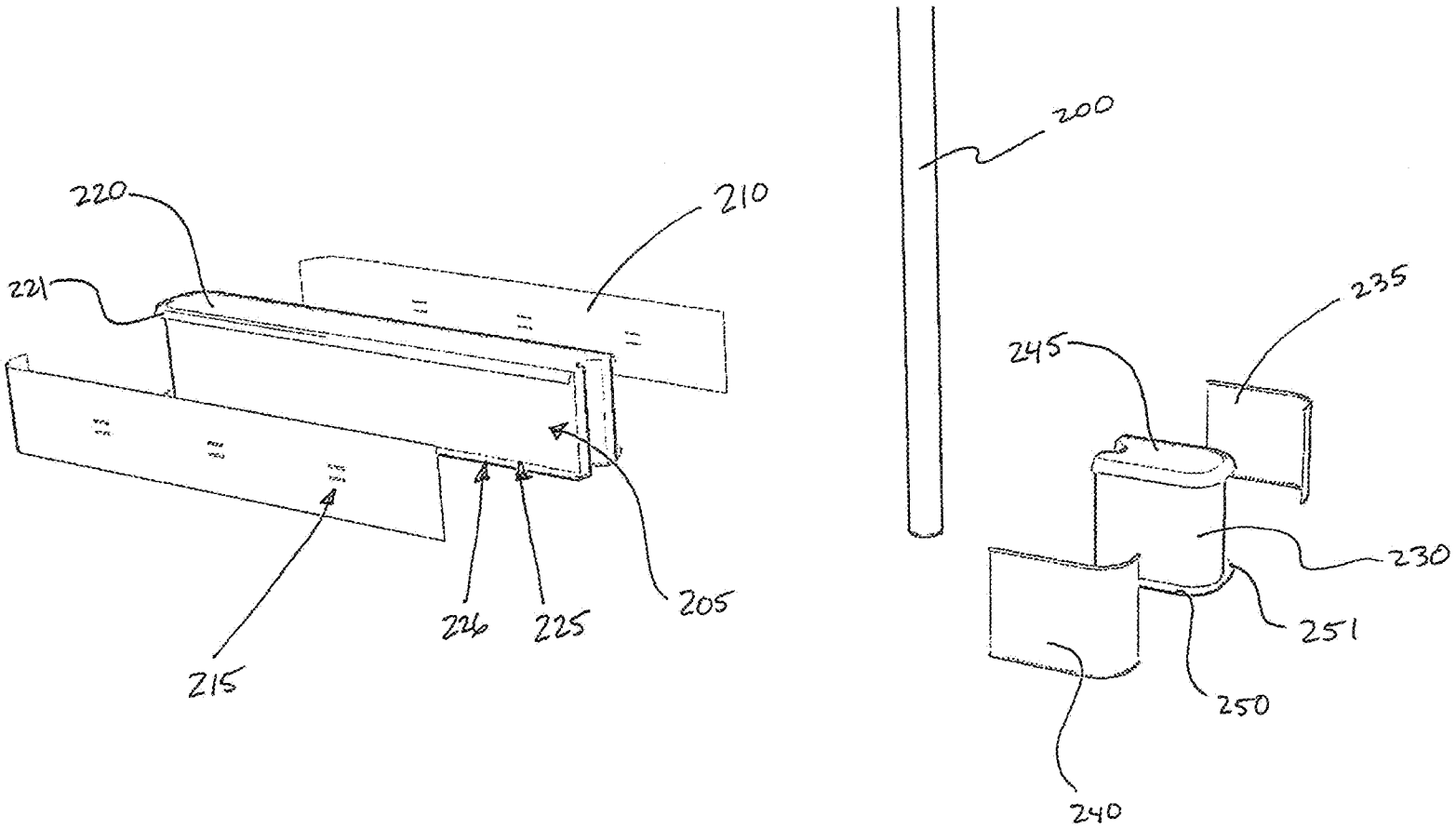
FIG. 2 illustrates an adjustable pole support member and differing sized compressible foam blocks and foam block covers in accordance with the present invention.

FIG. 2 illustrates the combination of an adjustable pole support member 200, a compressible foam block 205, rear foam block cover 210, front foam block cover 215, upper block housing 220, lower block housing 225 that together form one embodiment of a modular partition segment 115. To construct a typical piece of the partition, compressible foam block 205 is fitted with an upper block housing 220 and a lower block housing 225. In one embodiment, the upper block housing 220 and lower block housing 225 each have a raised ridge running along the perimeter the surface of each such that the area within the raised ridge of the upper block housing 220 and lower block housing 225 is pressed onto the top and bottom respectively of the compressible foam block 205 and held firmly in place. In the illustrated embodiment, rear foam block cover 210 and front foam block cover 215 are constructed of a rigid plastic material and are snap fit into the area created between the upper block housing channel 221 of upper block housing 220 and lower block housing channel 226 of lower block housing 225. One of ordinary skill in the art can appreciate that any plastic or other composition of materials may be used for front and rear foam block cover 215, 210 and upper and lower block housing 220, 225 with the properties of the combination of strength and stiffness. In an alternative embodiment, front and rear foam block cover 215, 210 may comprise a foam block stiffener (not shown) that is low cost and simply adds strength, firmness and stability to the compressible foam block 205, such as a plastic rod or a flat piece of plastic. The resulting covered foam partition element is then attached to the adjustable support member 200 in a stacked arrangement to create the modular partition segment 115. The straightforward and easy to understand construction of modular partition system 100 is scalable and customizable to almost any room shape and ceiling height.

FIG. 2 also shows a much smaller sized compressible foam block 230, rear foam block cover 235, front foam block cover 240, upper block housing 245, lower block housing 225 that in combination form another embodiment of a modular partition segment 105. Like the much larger piece, compressible foam block 230 is fitted with an upper block housing 245 and a lower block housing 250. In one embodiment, the upper block housing 245 and lower block housing 250 each have a raised ridge running along the perimeter the surface of each such that the area within the raised ridge of the upper block housing 245 and lower block housing 250 is pressed onto the top and bottom respectively of the compressible foam block 230 and held firmly in place. In the illustrated embodiment, rear foam block cover 235 and front foam block cover 240 are constructed of a rigid plastic material and are snap fit into the area created between the upper block housing channel 246 of upper block housing 245 and lower block housing channel 251 of lower block housing 250. A range of sizes demonstrates how the illustrated inventive aspect may be configured to customize the modular partition system to various room shapes and ceiling heights.

Figure 2A:
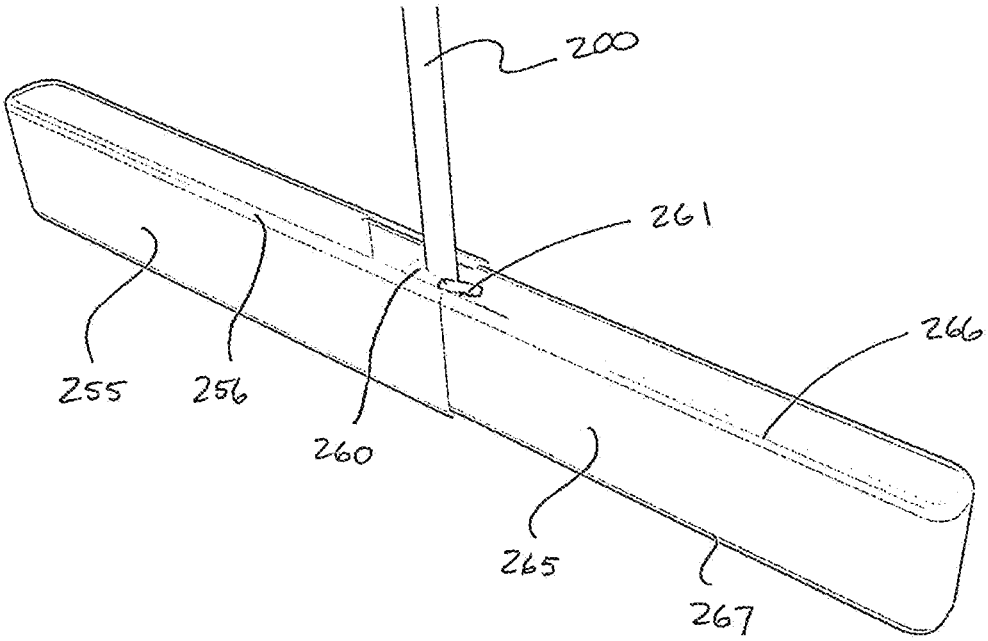
FIGS. 2A and 2B illustrates a perspective view of another embodiment of compressible foam blocks in accordance with the present invention.
Figure 2B:
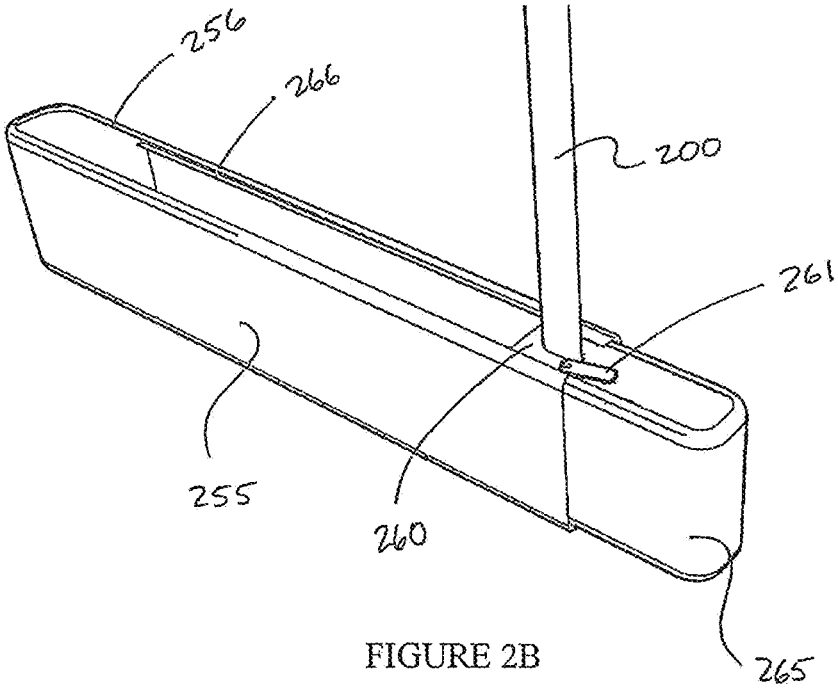

FIGS. 2A and 2B illustrates a perspective view of another embodiment for forming a modular partition segment 115 utilizing an adjustable pole support member 200 and an adjustable partition segment formed from block members 255, 265 in accordance with the present invention. In particular, first block member 255 is secured to the adjustable pole support member 200 utilizing a latch mechanism 260, 261 and a second block member 265 is configured to slide within the first block 255 as illustrated and locked into place by any conventional means to form an adjustable partition segment. More specifically, first block member 255 is constructed to be slightly larger than second block member 265 so that second block member 265 slides within the interior and locks in place using serrated teeth, locking holes or similar locking mechanism, which allows the first block member 255 to be removably secured relative to the second block member 265 while also allowing the two block members to be easily separated and reused. In the illustrated embodiment, first block member 255 has a channel 256 that runs along the top and a channel 257 that runs along the bottom. Second block member 265 has an upper channel 266 that slides under the upper channel 256 and lower channel 267 that slides on the lower channel 257. The two block members lock into place when an appropriate size is achieved creating a single adjustable segment of the overall modular partition segment 115.

Figure 2C:
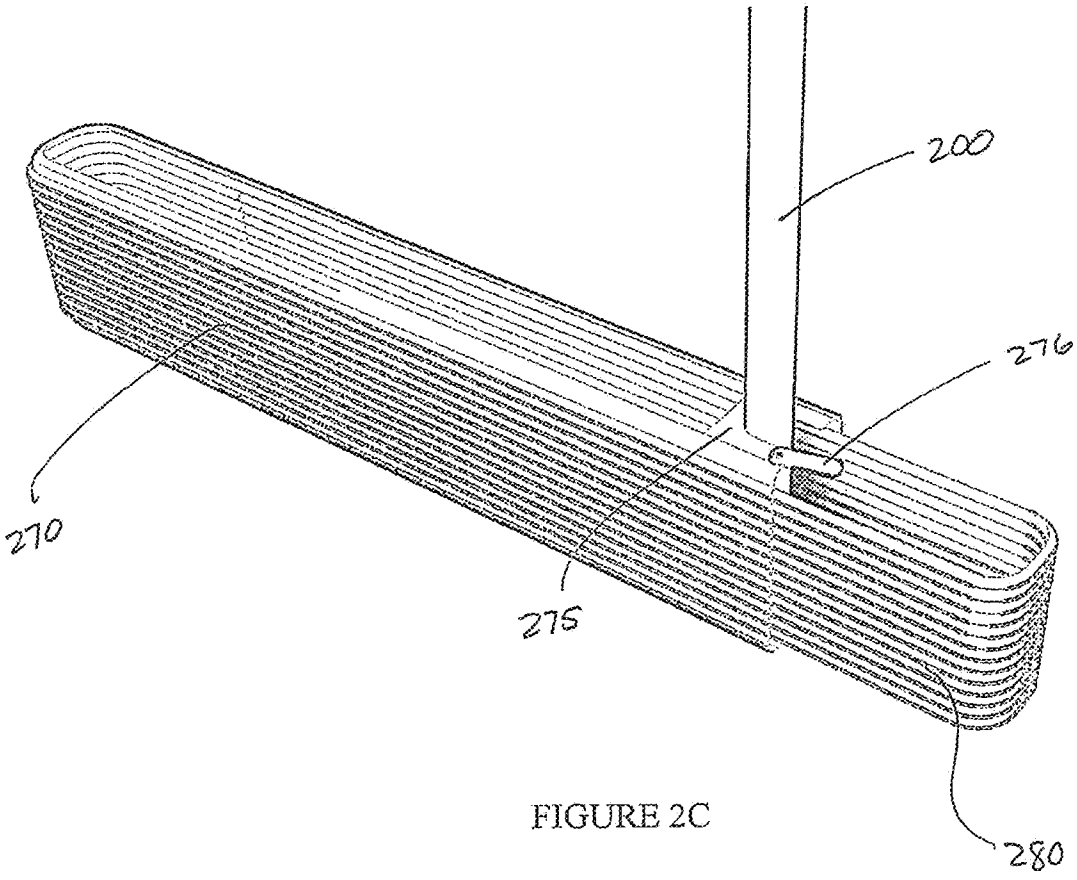
FIG. 2C illustrates a perspective view of another embodiment of compressible foam blocks in accordance with the present invention.

FIG. 2C illustrates a perspective view of another embodiment for forming a modular partition segment 115 utilizing an adjustable pole support member 200 and a single adjustable partition segment formed from first and second block members 270, 280 utilizing a latch mechanism 275, 276 in accordance with the present invention. First and second block members 270, 280 may be constructed of a hard plastic or a soft compressible material. One of ordinary skill in the art can appreciate that any material may be utilized for the first and second block members 270, 280 for either the hard or soft embodiments without departing from the scope and spirit of the present invention.

Figure 3:
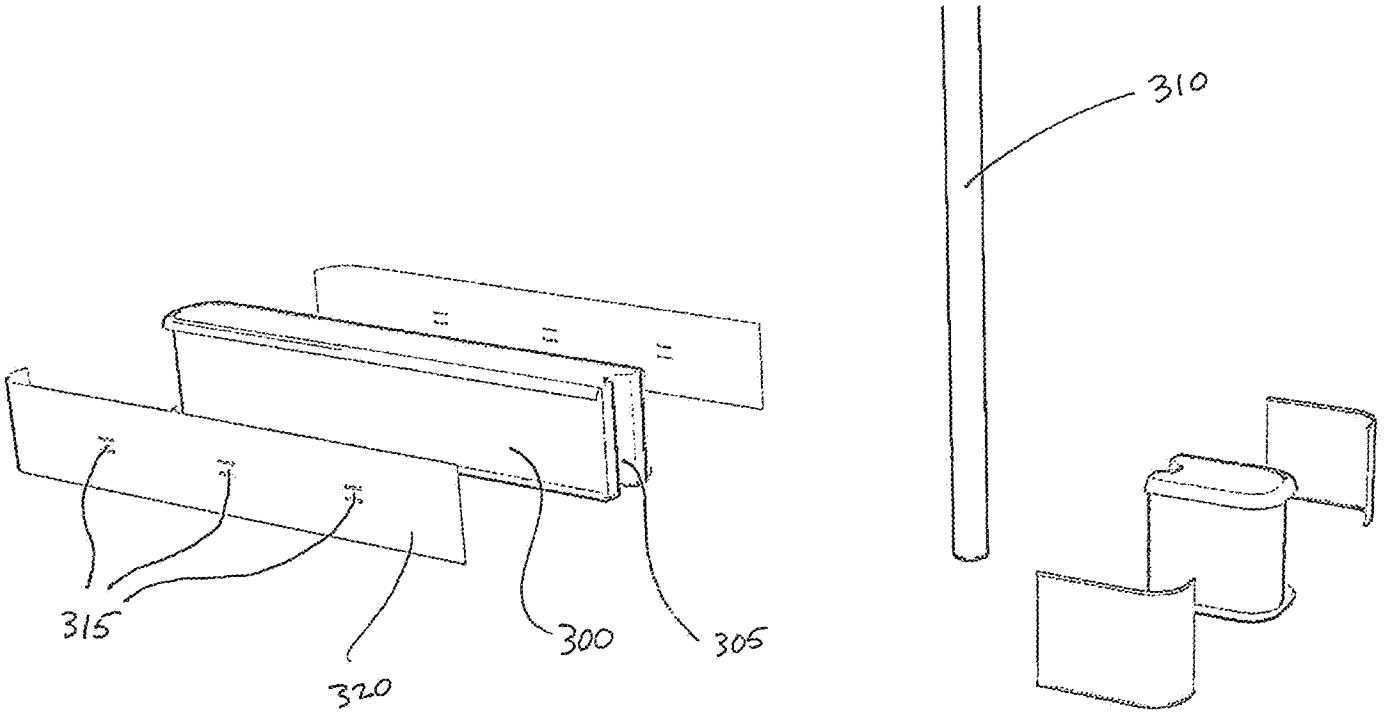
FIG. 3 illustrates a compressible foam block and corresponding connector channel for coupling the foam block to the adjustable pole support member in accordance with the present invention.

FIG. 3 illustrates a front perspective view of the connector channel 305 of compressible foam block 300 for removably securing a compressible foam block to the adjustable pole support member 310. Connector channel 305 is curved and sized to closely match the curve of the adjustable pole support member 310 to secure couple the compressible foam block 300 to adjustable pole support member 310 while not being tight but instead sufficiently sized with enough give or play to simultaneously provide for rotation relative to the adjustable pole support member 310. In the illustrated construction, the entire final partition segment constructed of a plurality of compressible foam blocks stacked on top of one another rotates around the adjustable pole support member to provide, for example, a door or an emergency egress to name a few.

FIG. 3 also shows plurality of pre-drilled accessory holes 315 within rigid foam block face plate 320 for attaching various accessories (not shown).

Figure 3A:
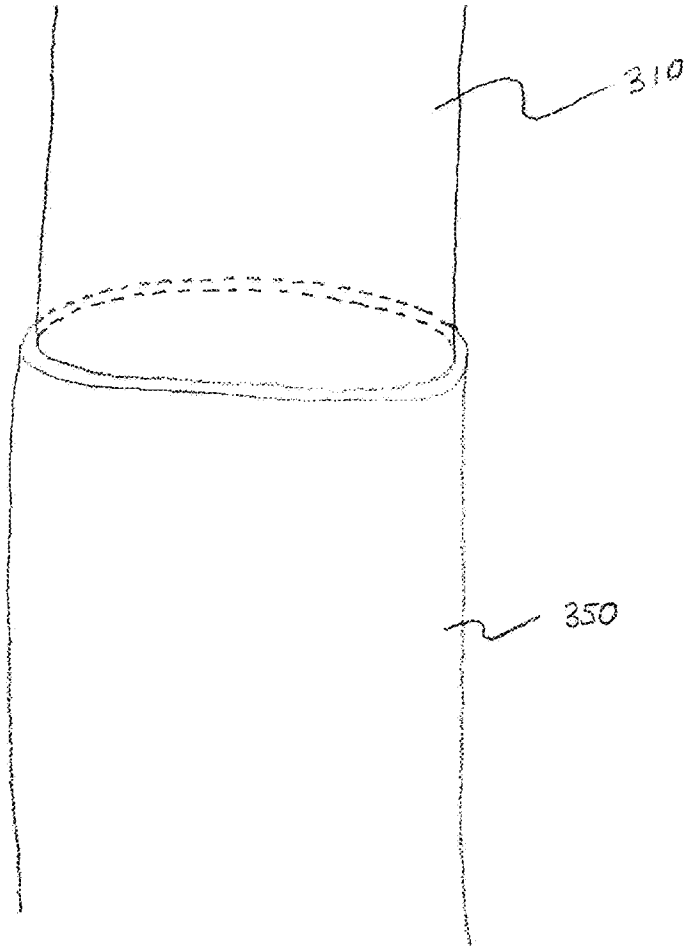
FIG. 3A illustrates a front perspective view of an alternative embodiment for securing a plurality of compressible foam blocks to an adjustable pole support member.

FIG. 3A illustrates a front perspective view of an alternative embodiment for securing a plurality of compressible foam blocks to an adjustable pole support member. As shown, adjustable pole support member 310 is seated within an outer sheath 350. Outer sheath 350 is configured to rotate relative to adjustable pole support member 310. In operation, a plurality of compressible foam blocks is fixed to the outer sheath 350 in a manner suitable for the desired design and configuration criteria. In this manner, a partition comprised of a plurality of compressible foam blocks fixed to the outer sheath 350 rotates relative to the adjustable pole support member 310. So, the alternative embodiment allows the adjustable pole support member 310 may be firmly fixed to the ceiling and floor while at the same time allowing the partition to rotate.

Figure 4:
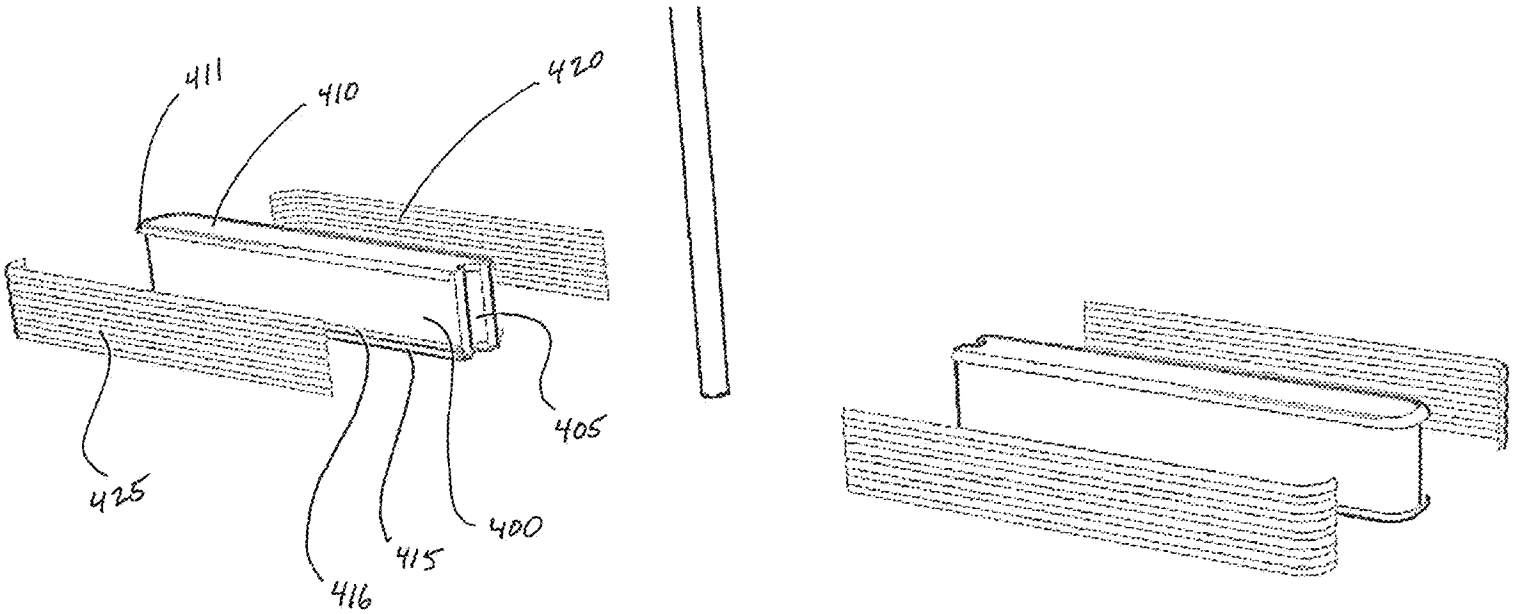
FIG. 4 illustrates a compressible foam block and compressible top foam block face plate for creating a relative soundproof seal between the top of the modular partition and the ceiling in accordance with the present invention.

FIG. 4 is a front perspective view of a combination of elements that may be used to construct a compressible piece to be used at the top of a modular partition segment 115 to create a tight seal between the partition and the ceiling. In the illustrated embodiment, a compressible foam block 400 is provided. To construct a typical uppermost compressible piece of the partition, compressible foam block 400 is fitted with an upper block housing 410 and a lower block housing 415. In one embodiment, the upper block housing 410 and lower block housing 415 each have a raised ridge running along the perimeter the surface of each such that the area within the raised ridge of the upper block housing 410 and lower block housing 415 is pressed down and onto the top and bottom respectively of the compressible foam block 400 and held firmly in place. In the illustrated embodiment, back compressible top foam block face plate 420 and front compressible top foam block face plate 425 are constructed of a compressible plastic material and are snap fit into the area created between the upper block housing channel 411 of upper block housing 410 and lower block housing channel 416 of lower block housing 415. One of ordinary skill in the art can appreciate that any compressible plastic or other composition of materials may be used for back compressible top foam block face plate 420 and front compressible top foam block face plate 425 with the combination of strength and accordion-like compressibility. The resulting partition piece is then attached to the adjustable support member at the very top of the stacked arrangement to create the seal between the modular partition segment 115 and the ceiling.

Figure 5:
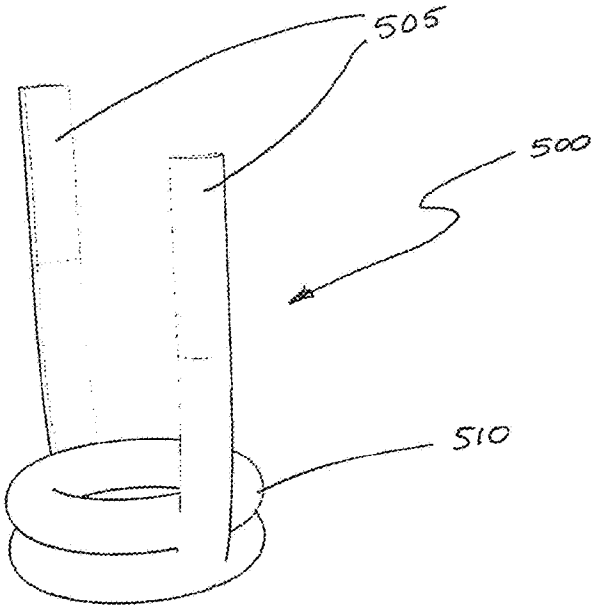
FIGS. 5 and 6 illustrate a foam block installation tool in accordance with the present invention.
Figure 6:
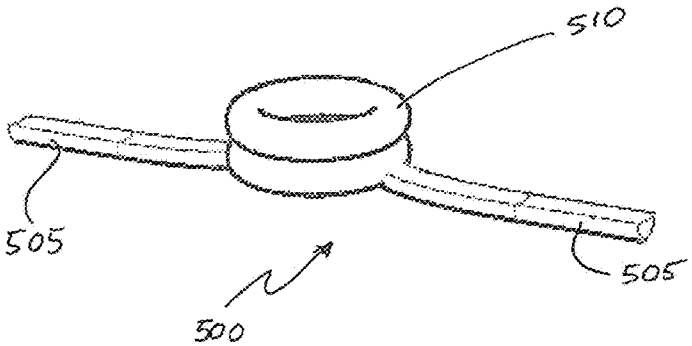

FIGS. 5 and 6 illustrate a foam block installation tool 500 for use by an individual for the installation of the modular partition segments 115 of modular partition system 100. Foam block installation tool 500 is constructed of a loop 510 sized to fit around the adjustable pole support member and a pair of folding wings 505 to build the modular partition segment 115 from the ground up without the need of a ladder. In operation, to avoid excessive strain of lifting multiple blocks, block installation tool 500 can be placed on the adjustable pole support member directly above a single block height. Block installation tool 500 has a loop 510 in middle that wraps around the adjustable pole support member and can open and close to be easily attached to and removed from the pole. As each block is complete below, it is lifted and the folding wings 510 of the block installation tool 500 are also lifted up. Then, the block will be let back down and wings will fold down, holding the block at height. This operation allows the user to place another block below the installer and lift it up as well, gradually constructing the stack of blocks of partition segment 115.

Figure 7:
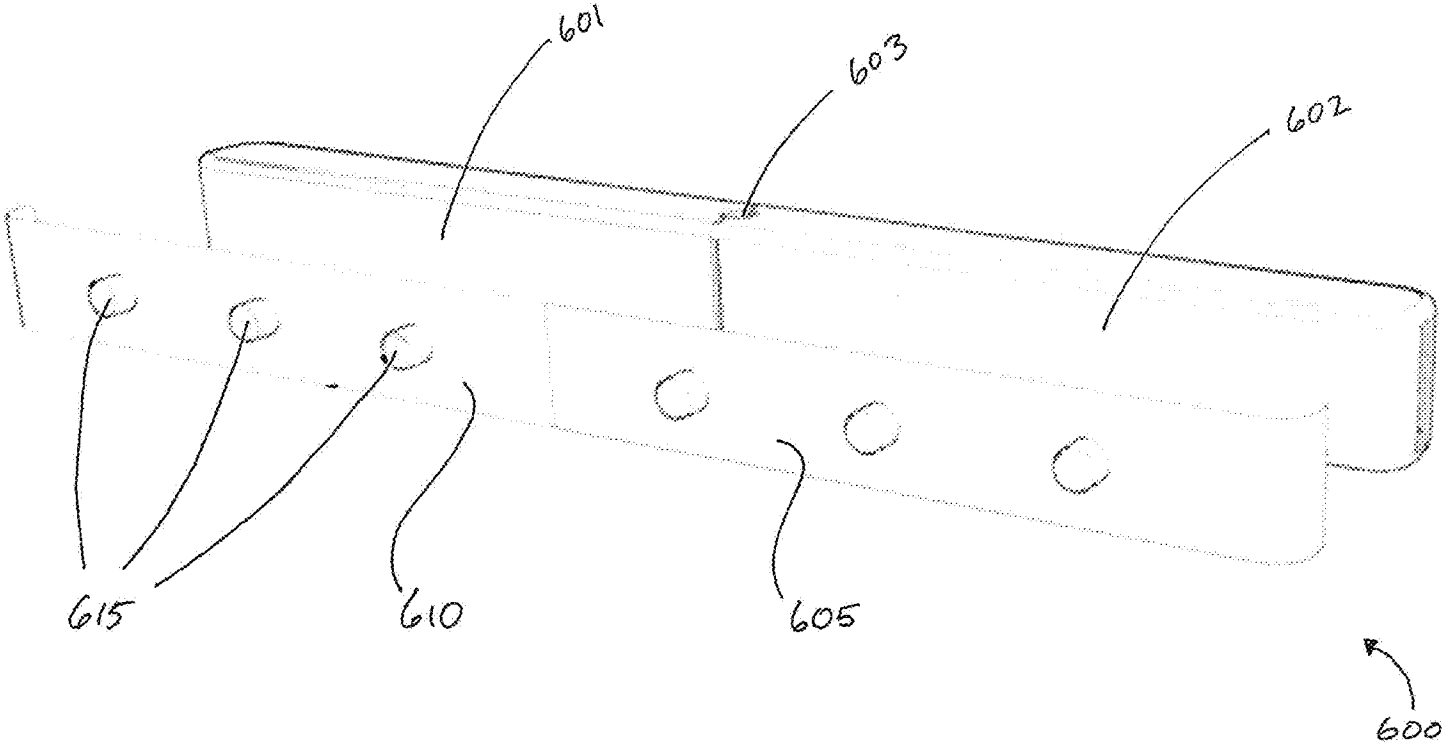
FIG. 7 illustrates a compressible foam block and rigid foam block face plate showing a plurality of plugs as accessories in accordance with the present invention.

In the illustrated embodiment of FIG. 7, a pair of compressible foam blocks 600, 601 is shown abutting each other where each of their respective connector channels 602, 603 meet on an adjustable pole support member (not shown). A pair of rigid foam block face plates 605, 610 are shown having a plurality of plugs 615 inserted within the pre-drilled holes. One of ordinary skill in the art will appreciate that any number of accessories may be used in place of the plugs 615 utilizing the inventive aspects of the disclosed design of the accessory without departing from the scope and spirit of the present invention.

Figure 8:
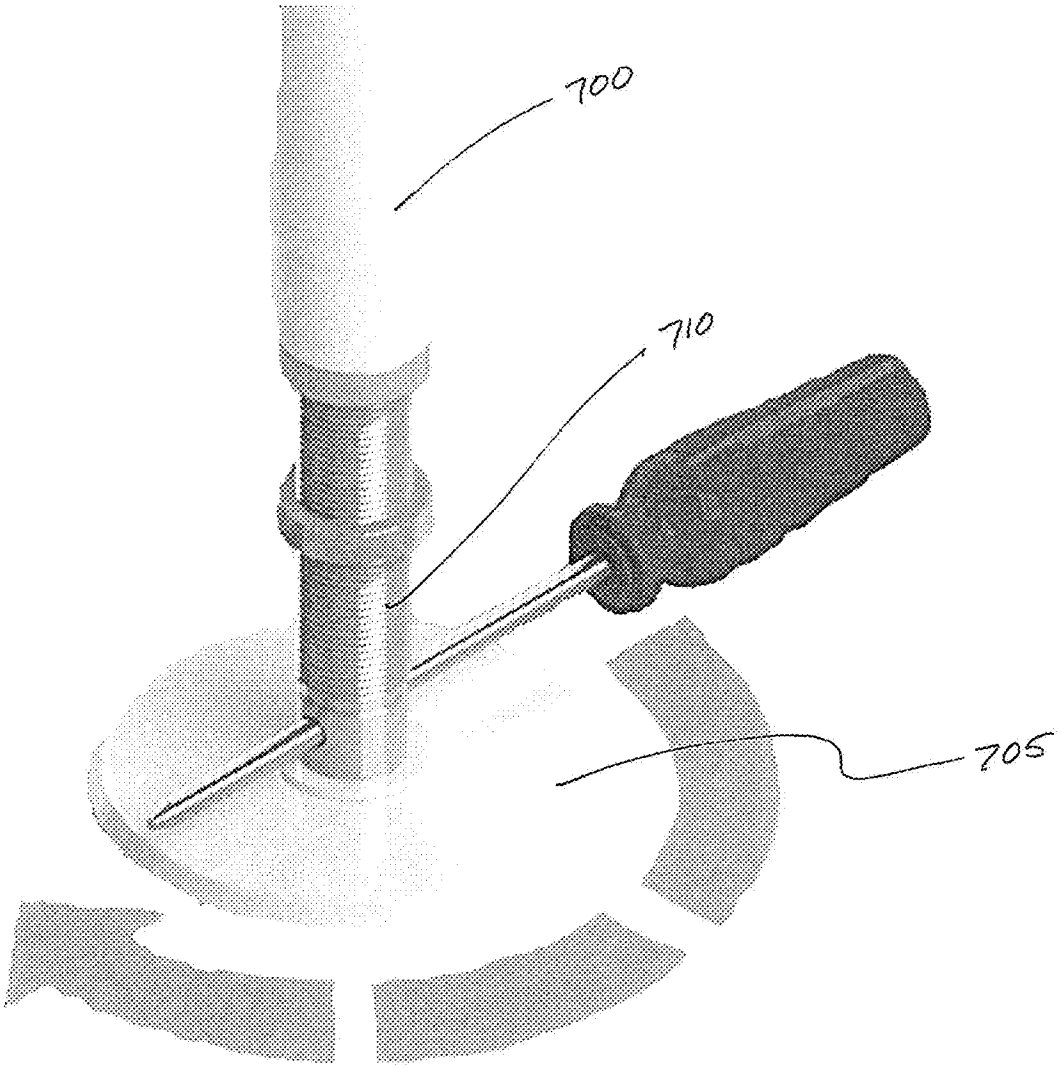
FIG. 8 illustrates an adjustable pole support member having a base plate and jackscrew expansion mechanism in accordance with the present invention.

FIG. 8 is a perspective view of an adjustable pole support member 700 having a base plate 705 and jackscrew expansion mechanism 710. Adjustable pole support member 700 may be installed in minutes between a floor and ceiling and is held by a jackscrew expansion. The jackscrew expansion mechanism 710 expands the pole 700 to create enough tension between the floor and ceiling to hold the pole 700 securely in place. Rubber pads on the ceiling plate and the floor plate (not shown) hold the adjustable pole support member 700 in place and prevent marring of the ceiling or floor. No drilling is necessary—adjustable pole support member 700 expands between floor and ceiling simply by turning screw at the bottom of the pole. One of ordinary skill in the art can appreciate that any similar tension methodology may be utilized in place of the jackscrew expansion mechanism 710 illustrated and described in FIG. 8 without departing from the scope and spirit of the present invention.

Figure 9:
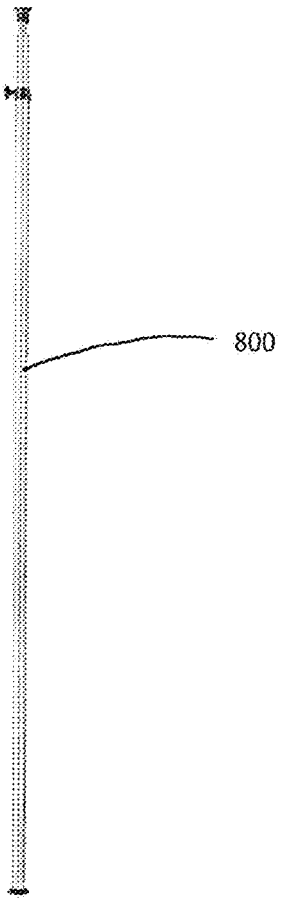
FIG. 9 illustrates a telescoping adjustable pole support in accordance with the present invention.

FIG. 9 illustrates a telescoping adjustable pole support member 800 for use in constructing a partition segment 115 of the modular partition system 100. In one embodiment, telescoping adjustable pole support member is a two-piece construction that locks and unlocks with a twist.

Figure 10:
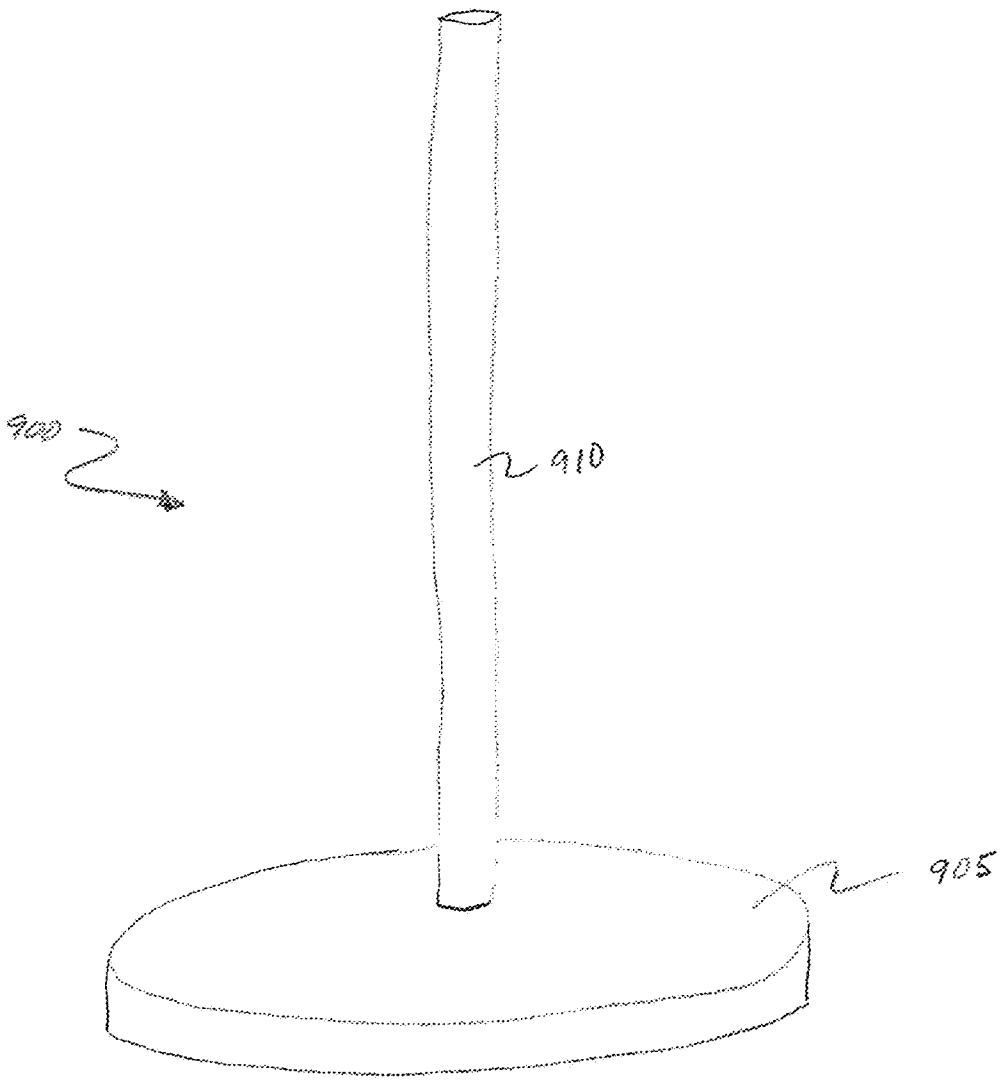
FIG. 10 illustrates a free-standing adjustable pole support member.

FIG. 10 illustrates a free-standing adjustable pole support member 900 for use in constructing a partition segment 115 of the modular partition system 100. Free-standing adjustable pole support member 900 has a pole support member base 905 and adjustable pole member 910, which may be telescoping or fixed and may also include the sheath design illustrated and described with respect to FIG. 3A. In one example, free standing adjustable pole support member 900 may be used for a room design with high ceilings. One of ordinary skill in the art can appreciate that any similar free-standing base methodology may be utilized in place of the free-standing adjustable pole support member 900 illustrated and described in FIG. 10 without departing from the scope and spirit of the present invention.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A modular partition for use in a room having a floor and a ceiling, the modular partition system comprising:

an adjustable pole support member configured to be rigidly secured in a position between the floor and the ceiling by tension to hold the pole securely in place, said adjustable pole support member configured to be removable from the rigidly secured position between the floor and the ceiling to move the modular partition from a first room to a second room;

a plurality of compressible foam blocks configured to be attached and removed from the adjustable pole support member, each block having a connector channel at one end for fastening each compressible foam block to the adjustable pole support, wherein the connector channel permits each compressible foam block to rotate relative to the adjustable pole support member;

a plurality of foam block covers, each foam block cover sized to be securely affixed to a front and back of a respective said compressible foam block, wherein the plurality of foam block covers provides strength and structural support to each foam block of the modular partition; and an upper block housing having an upper block housing channel and a lower block housing having a lower block housing channel, the upper block housing and lower block housing removably attached to a top and bottom of each compressible foam block, wherein each foam block cover snap fits within the upper block housing channel and the lower block housing channel.

2. The modular partition of claim 1, further comprising an outer sheath concentrically disposed over the adjustable pole support member, wherein the connector channel associated with each block fastens each compressible foam block to the outer sheath and wherein the outer sheath and compressible foam blocks rotate relative to the pole support member.

3. The modular partition of claim 1, wherein the adjustable pole support member comprises a telescoping pole support member.

4. The modular partition of claim 1, wherein the plurality of foam block covers further comprise a plurality of front foam block covers and a plurality of rear foam block covers, each front foam block cover is configured to be affixed to the front of the respective compressible foam block, and each rear foam block cover is configured to be affixed to rear of the respective compressible foam block.

5. The modular partition of claim 1, further comprising a compressible top foam block face plate configured to attach to the upper block cover housing and lower block cover housing on the front and back of the respective compressible foam block closest the ceiling, wherein the compressible top foam block face plate is designed to conform to a contour of the ceiling.

6. The modular partition of claim 1, wherein the connector channel of the compressible foam block is magnetized.

7. The modular partition of claim 1, wherein the connector channel of the compressible foam block is sized to be pressure fit onto the adjustable pole support member.

8. The modular partition of claim 1, wherein each compressible foam block further comprises a first block member secured to the adjustable pole support member and a second block member configured to slide within the first block, wherein the first block member is constructed to be slightly larger than second block member so that second block member slides within interior thereof and locks in place.

9. The modular partition of claim 1, wherein the adjustable pole support member comprises a tension pole support member.

10. The modular partition of claim 9, wherein the tension pole support member further comprises a base plate, a plurality of rubber pads fixed to the base plate and the top surface of the tension pole support member, and a jackscrew expansion mechanism wherein the jackscrew expands the pole to create tension between the floor and ceiling to hold the tension pole support member securely in place.

11. A modular partition for use in a room having a floor and a ceiling, the modular partition comprising:

a free-standing adjustable pole support member configured to be removable from a rigidly secure position between the floor and the ceiling to move the modular partition from a first room to a second room;

an outer sheath concentrically disposed to the free-standing adjustable pole support member, wherein the outer sheath rotates relative to the free-standing adjustable pole support member;

a plurality of compressible foam blocks formed to be attached and removed from the outer sheath, each block having a connector channel at one end for fastening each compressible foam block to the outer sheath, wherein the connector channel fixes each compressible foam block to the outer sheath and permits each compressible foam block to rotate relative to the adjustable pole support member;

an upper block housing and a lower block housing removably attached to a top and bottom of each compressible foam block; and a plurality of rigid foam block face plates, each rigid foam block face plate configured to attach to the upper block cover housing and lower block cover housing on a front and back of each compressible foam block, wherein each rigid foam block face plate snap fits within the upper block housing and the lower block housing and wherein the plurality of rigid foam block face plates provides strength and structural support to each foam block of the modular partition.

12. The modular partition of claim 11, wherein the plurality of rigid foam block face plates further comprise a plurality of front rigid foam block face plates and a plurality of rear rigid foam block face plates, each front rigid foam block face plate is configured to be affixed to the front of a compressible foam block, and each rear rigid foam block face plate is configured to be affixed to the rear of a compressible foam block.

13. The modular partition of claim 11, wherein the upper block housing and lower block housing further comprise an upper block housing channel and a lower block housing channel respectively, the upper block housing and lower block housing are constructed to be removably attached to the top and bottom of each compressible foam block, wherein each rigid foam block face plate snap fits onto the upper block housing channel and the lower block housing channel.

14. The modular partition of claim 11, wherein at least one foam block cover has predrilled holes for attaching accessories.

15. The modular partition of claim 11, wherein the adjustable pole support member comprises a telescoping pole support member.

16. The modular partition of claim 15, wherein the free-standing adjustable pole support member further comprises a base plate, a plurality of rubber pads fixed to the base plate.

17. A modular partition system for use in a room having a floor and a ceiling, the modular partition system comprising:

a plurality of adjustable pole support members configured to be rigidly secured in a position between the floor and the ceiling by tension to hold the pole securely in place, said plurality of adjustable pole support members configured to be removable from the rigidly secured position between the floor and the ceiling to move the modular partition from a first room to a second room;

a plurality of compressible foam blocks configured to be attached and removed from the adjustable pole support member, each block having a connector channel at one end for securely fastening each compressible foam block to the adjustable pole support, wherein the connector channel permits each compressible foam block to rotate relative to the adjustable pole support member;

a plurality of foam block covers, each foam block cover sized to be securely affixed to a front and back of a respective said compressible foam block, wherein the plurality of foam block covers provides strength and structural support to each foam block of the modular partition; and a plurality of upper block housing members each having an upper block housing channel and a plurality of lower block housing member having a lower block housing channel, the upper block housing member and lower block housing member removably attached to a top and bottom of each compressible foam block, wherein each foam block cover snap fits onto the upper block housing channel and the lower block housing channel; and wherein the plurality of foam block covers further comprise a plurality of front foam block covers and a plurality of rear foam block covers, each front foam block cover is configured to be affixed to the upper block housing channel and the lower block housing channel on the front of the respective compressible foam block, and each rear foam block cover is configured to be affixed to onto the upper block housing channel and the lower block housing channel on a rear surface of the respective compressible foam block.

18. The modular partition of claim 17, further comprising a plurality of compressible top foam block face plate configured to attach to the upper block cover housing and lower block cover housing on the front and back of the respective compressible foam block closest the ceiling, wherein the compressible top foam block face plate is designed to conform to a contour of the ceiling.

* * * * *